US006393788B1

(12) United States Patent
Flores

(10) Patent No.: US 6,393,788 B1
(45) Date of Patent: May 28, 2002

(54) ADJUSTABLE SCREED

(76) Inventor: Leo Flores, P.O. Box 467, Bonsall, CA (US) 92003

( * ) Notice: Subject to any disclaimer, the term of this patent is extended or adjusted under 35 U.S.C. 154(b) by 0 days.

(21) Appl. No.: 09/723,583

(22) Filed: Nov. 27, 2000

(51) Int. Cl.[7] ..... E04F 13/12

(52) U.S. Cl. ..... 52/365; 52/256; 52/257; 52/288.1; 52/371; 52/226.1; 52/364; 312/140.4; 108/27

(58) Field of Search ..... 52/254, 255, 256, 52/257, 287.1, 288.1, 364, 365, 367, 368, 371, 372, 127.3, 707, 718.01, 718.02, 726.1; 312/140.1, 140.4; 108/27

(56) References Cited

U.S. PATENT DOCUMENTS

| | | | | |
|---|---|---|---|---|
| 1,699,557 A | | 1/1929 | Yeager | |
| 2,708,088 A | | 5/1955 | Steinke | |
| 3,156,282 A | | 11/1964 | Bedford, Jr. | |
| D212,446 S | | 10/1968 | McCarthy | |
| 3,522,684 A | * | 8/1970 | Grossman | 52/393 |
| 4,129,971 A | * | 12/1978 | Reusser | 52/288.1 |
| 4,945,698 A | | 8/1990 | Jertberg et al. | |
| 5,060,438 A | | 10/1991 | O'Rourke | |
| 5,348,384 A | * | 9/1994 | Hull et al. | 52/287.1 X |
| 5,408,724 A | | 4/1995 | Mullet et al. | |
| 5,722,746 A | * | 3/1998 | Hull et al. | 52/287.1 X |
| 5,924,253 A | * | 7/1999 | Walker | 52/415 |
| 5,992,115 A | * | 11/1999 | Felix | 52/465 |
| 6,074,129 A | | 6/2000 | Nowak et al. | |

* cited by examiner

*Primary Examiner*—Carl D. Friedman
*Assistant Examiner*—Brian E. Glessner
(74) *Attorney, Agent, or Firm*—Frank C. Morkunas

(57) ABSTRACT

An adjustable screed with a body having a top rail and a bottom rail; a horizontal adjustment mechanism for establishing a horizontal plane for the screed and for securely maintaining the horizontal plane; a vertical stabilizing mechanism for attaching the screed to an external object; a securing mechanism for securing the screed to the external object; and a registration mechanism for registering one screed to another screed after initial adjustments have been made to the first screed secured to the external object.

24 Claims, 4 Drawing Sheets

FIG. 12
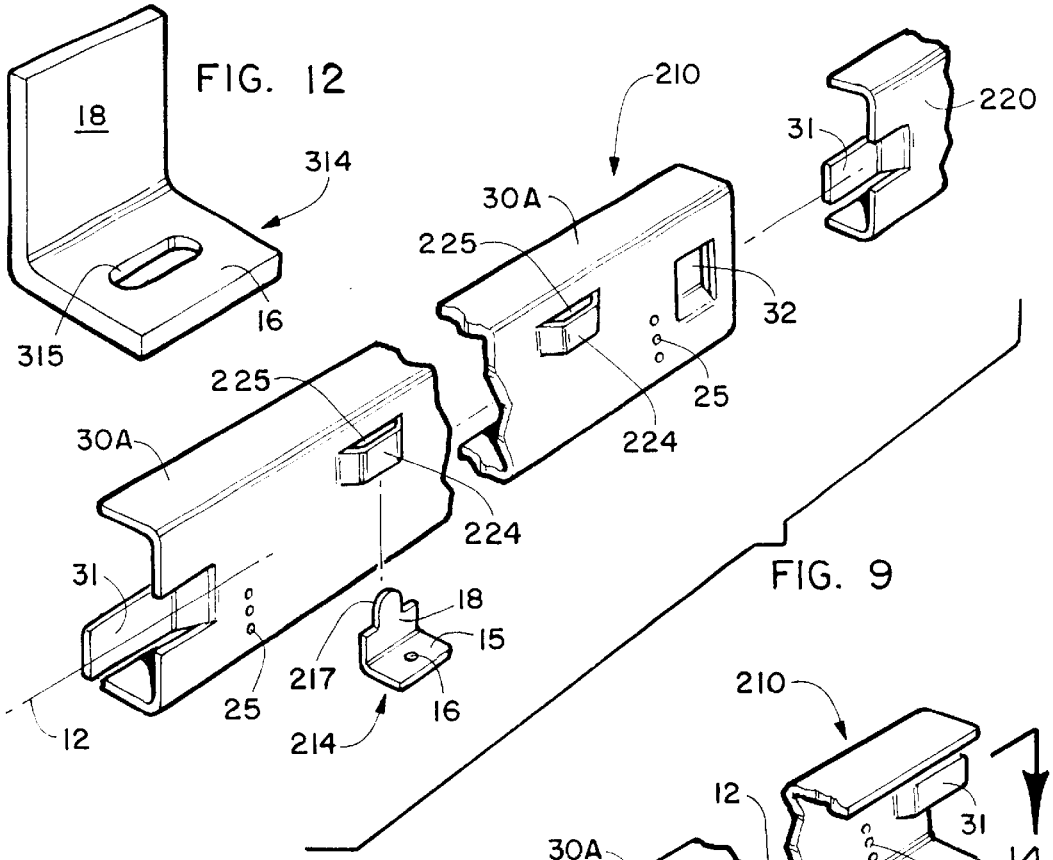
FIG. 9
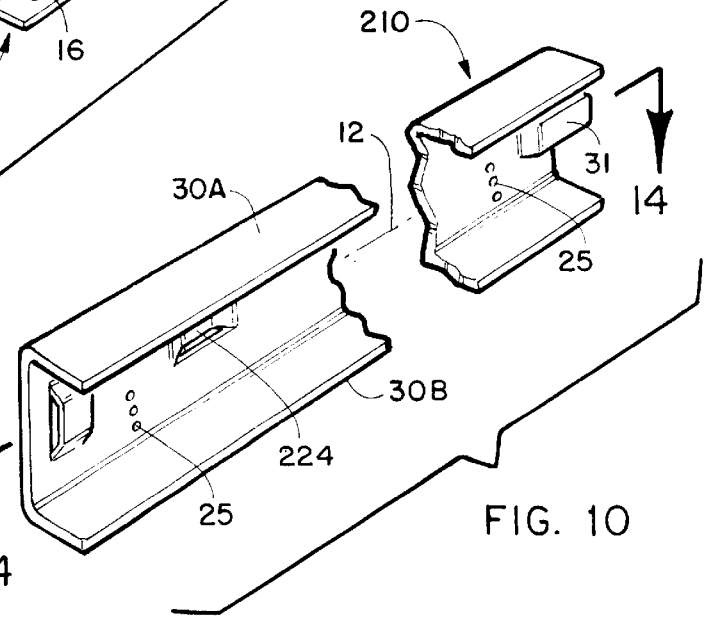
FIG. 10
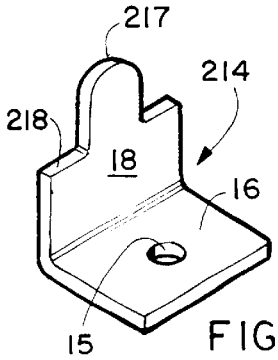
FIG. 11
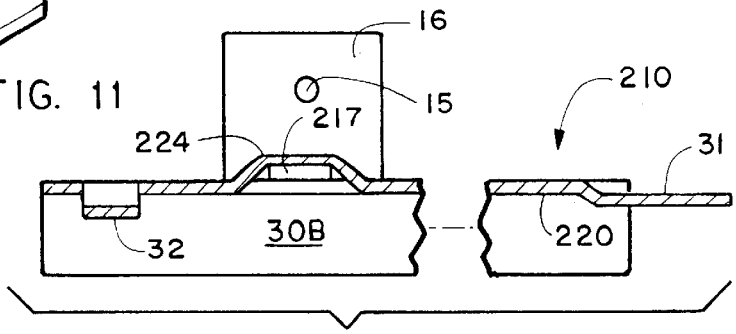
FIG. 14

ADJUSTABLE SCREED

CROSS REFERENCES TO RELATED APPLICATIONS

None.

STATEMENT REGARDING FEDERALLY-SPONSORED RESEARCH OR DEVELOPMENT

Not applicable.

BACKGROUND OF THE INVENTION

This present invention relates to an improvement in screeds, and more particularly to screeds which are adjustable and when adjusted to a desired horizontal plane, maintain horizontal and vertical stability.

A basic screed is a device used to establish an accurate level and flat surface over an existing surface, such as a counter-top, before resurfacing the existing surface with, for example, tiles. Most existing 'flat' surfaces appear to the naked eye to be perfectly flat and horizontal but in fact they generally are not. If tile, such as ceramic tiles or marble tiles and the like, are to be properly laid over the existing surface, that existing surface must be flat-in-fact and horizontal. A screed is a device used to establish a flat and horizontal plane over an existing surface before the tile work is done over that existing surface. The screed basically is a long body (generally made of metal) of any width which, at the tops and bottoms has a perpendicular projecting edge (or rail) running the full length of the metal body. It resembles the letter "E" but without the middle horizontal line with the top and bottom lines shorter. In the body of the screed are numerous large holes and several vertical slots.

Screeds are attached around an existing surface with the top and bottom edges facing outward from the existing surface. In this regard, fasteners (typically nails) are snugly placed through the slots and into a counter (which is to be re-surfaced) near the top. The nails attach and hold the screed to the counter yet permit vertical movement of the screed by way of the slot. Taking a typical counter of basically rectangular shape, several screeds are so attached; each relatively independent of one another. Once so attached, a level horizontal plane is to be established. Generally a leveler is used on each screed to set a relatively perfect horizontal plane for the counter top. The tops of all the screeds attached must be aligned exactly with one another into a unitary horizontal plane. This is at least a two-person job. Once this unitary plane is established, the nails in the slots are driven fully into the existing surface to thereby secure the screeds to it. The screeds form a perimeter around the existing surface and above it.

After this is done, an appropriate sub-base in constructed over the existing surface and between the perimeters of the screeds. The last layer, or top, of this sub-base is generally a mortar bed. The mortar generally used is more dry than wet (because wet cement will drip on the floor) and, as a result, must be packed or tamped by the artisan. The large holes in the screed accommodate the flow of mortar into the outside surface of the screed and between the top and bottom edges but also cause sand-like particles to fall out and onto the floor. The top of the sub-base is smoothed using the top edges of the screeds as guides. The sides of the sub-base are formed between the top and bottom edges of the screed and they are smoothed out using the far outer ends of the top and bottom edges and guides. If the screeds were properly aligned and adjusted, after the sub-base is finished, the counter now has a virtually horizontal level flat top new surface upon which tiles may be more easily installed and display an even flat surface upon completion.

Needless to say, the process is cumbersome, tedious, and difficult. The labor is manual and intense. The screeds, as installed, do not have any vertical stability. The horizontal stability is limited to a driven nail or nails into a slot. In this working environment, much physical movement takes place. An accidental touching of the screed from the top could dislodge the horizontal alignment so painstakingly obtained. Minor movements may not even be noticed. The mortar bed of the sub-base is dense and heavy. It is placed within the perimeter formed by the screeds around the existing surface. Its sheer volume, weight, and tamping could displace the perpendicular arrangement of the screed to the horizontal plane. This displacement could be slight or extensive. If slight, it may go unnoticed, if extensive, further adjustments of one or more screeds must be made and maintained. This, at a time, when the sub-base is nearly complete, renders the task all the more difficult.

The prior art has adjusters and stabilizers of all sorts. None is as versatile or as easy to use to make the job more efficient and the result more professional. The present invention is a vast improvement over existing screeds and the improvements and enhancements of the past. It provides for a simplification to the process of establishing a true unitary horizontal plane, provides for the maintaining of that horizontal plane without dislodgement therefrom, provides for vertical stability, and further provides for a registration from screed to screed generally without need for further measurements of any later-placed screed.

The objects of the present invention are to:

a. make it easier to horizontally level an existing surface before applying a new surface thereon;

b. provide for an easy-to-use and easy-to-adjust screed assembly which maintains a horizontal and vertical plane;

c. provide a simplified registration between multiple screeds; and d. make it easier to establish and maintain a unitary horizontal plane and to more cleanly apply cement thereto.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates an adjustable screed with a body having a top rail and a bottom rail; a horizontal adjustment means for establishing a horizontal plane for the screed and for securely maintaining the horizontal plane; a vertical stabilizing means for attaching the screed to an external object and for maintaining its vertical stability to that external object; a securing means for securing the screed to the external object after a horizontal plane has been established; and a registration means for registering one screed to another whereby when one or more screeds are being attached to the external object, said top rails of each screed are aligned to a single horizontal plane and secured thereat.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which:

FIG. 9 is a perspective view of another embodiment of the improved screed assembly.

FIG. 10 is a perspective view, reverse-side, of the embodiment illustrated in FIG. 9.

FIG. 11 is a detailed view of the bracket member associated with the screed assembly illustrated in FIGS. 9 and 10.

FIG. 12 is a perspective view of another embodiment of the bracket member

FIG. 14 is a detailed, cross-section view, taken on line 14—14 of FIG. 10.

DETAILED DESCRIPTION OF THE INVENTION

Figure 1:
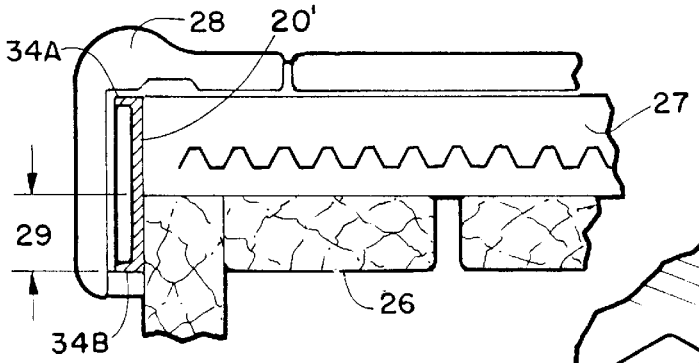
PRIOR ART FIG. 1
FIG. 1 is cross-section view of a conventional screed application on an existing surface.
Figure 2:
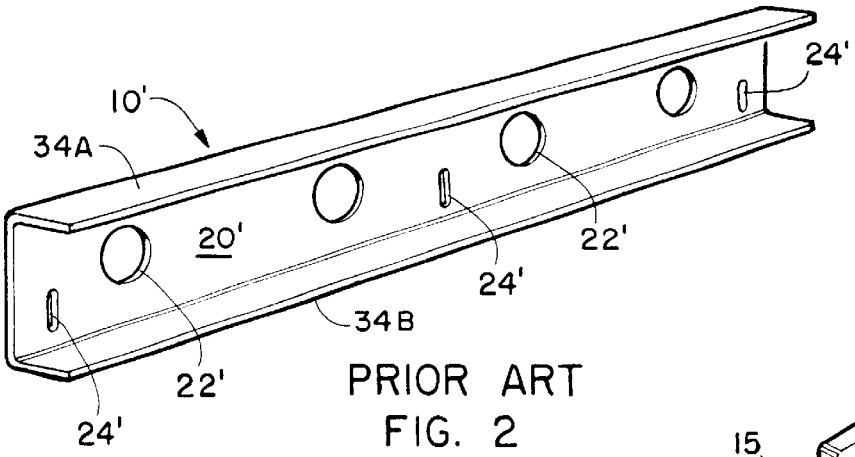
PRIOR ART FIG. 2
FIG. 2 represents a prior art screed.

Prior art application of screeds on existing surfaces is illustrated in FIG. 1. FIG. 2 depicts a prior art screed 10'. In FIG. 1, the body 20' of the screed 10' is shown to be attached to an external object (a counter {or sub-top} 26 for example) with the top edge (or rail) 34A and the bottom edge (or rail) 34B, each extending away from the body 20', facing away from the counter 26. Note the bottom rail 34B sits below the top plane of the counter 26 while the top rail 34A projects well above. The distance from the top of the counter 26 to the top edge generally should be sufficient to accommodate a sufficient amount of mortar, or its equivalent, to create a new top surface 27 (or mortar bed) which can be leveled to a relatively accurate horizontal plane and be smoothed flat. Channels 24' are for attaching the screed 10', by use of a suitable fastener (such as a nail), to the external surface. This is the only function of the channel 24' of the prior art screed 10'.

Large holes 22' accommodate the flow of mortar to create a side edge of mortar (for a mortared side) and to provide a means to retain the mortar therein by having an unbroken mortar link between the top surface and the side surfaces. The distance is dependent upon the height of the screed body 20 naturally, the desired depth of the new top surface 27, and the type of new covering 28 to be used. On typical counter tops, a sub-top depth of between one-quarter inch to one-and-one-half inch is suitable. Most typically, a three-quarter inch depth is used. It is upon this new top surface 27 that the new cover 28 (such as, but not limited to, ceramic tiles, marble tiles, composite tiles, and the like) is cemented and placed. A screed is then secured to the counter 26, generally at the 'meatiest' section 29 (that section where the counter top and its side meet and where nearly any length nail or screw may be driven to its full length).

Figure 18:
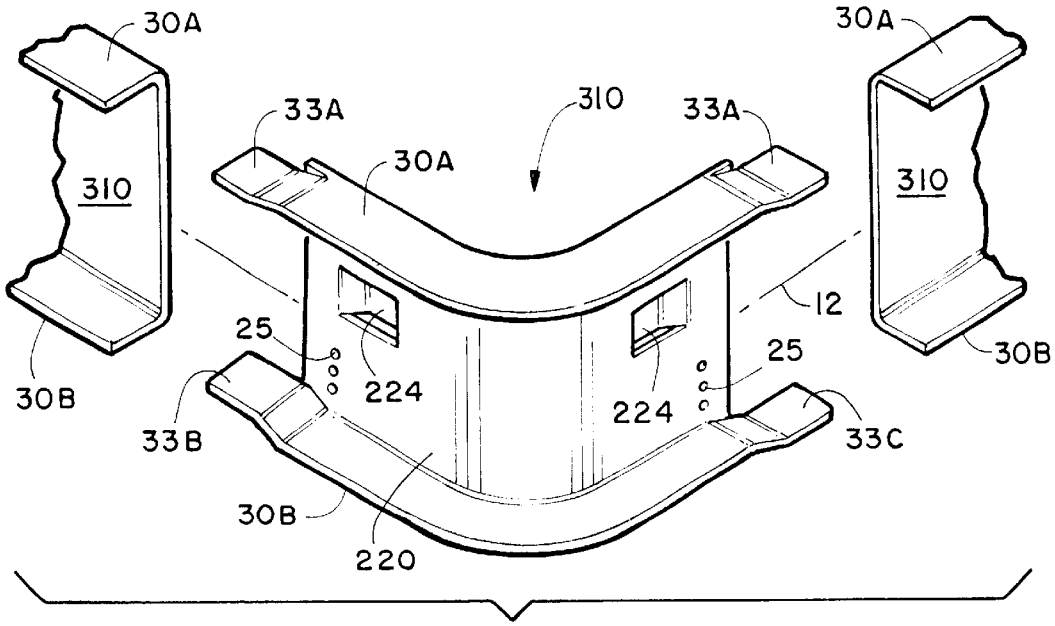
FIG. 18 is a perspective detailed view of yet another embodiment the registration mechanism between multiple screeds.

As earlier explained, current screeds are difficult to use, difficult to align, difficult to establish and maintain a unitary horizontal plane, and difficult to establish and maintain secure vertical stability while the counter 26 is being re-covered. These difficulties and obstacles have been overcome by the present invention. Referring now to the drawings embodying the present invention, and in particular to FIGS. 3 through 5, reference character 10 generally designates an adjustable screed constructed in accordance with a preferred embodiment of the present invention. The body 20, like a screed of prior art, is generally an elongated strip (though it need not be as illustrated in FIG. 18 as a corner piece) having a top rail 30A and a bottom rail 30B, each of which, like the prior art screeds 10', may be approximately perpendicular to the body 20 and projecting away from the body 20; or may be angled slightly toward each other to provide support for mortar placed therein for a new mortared side and to provide registration capability (explained fully later). If the rails 30A, 30B are angled, large holes 22 are not required.

Near the top rail 30A are one or more channels 24. These channels 24, in conjunction with bracket member 14 (and several other bracket member embodiments 114, 114', 214, and 314 as illustrated in FIGS. 6, 7, 11, and 12 and fully described below), function to establish a horizontal plane and to securely maintain the horizontal plane after it has been established.

This bracket member 14 has a base 16 and a wall 18 which is approximately perpendicular to the base 16. A pin or shaft 17 extends outward from the wall 18. A retaining member 19 is attached to the shaft 17. The retaining member 19 generally can be a bar or strip or any suitable configuration suited for the intended purpose of permitting insertion of the bracket member 14 into the channel 24 and retaining the bracket member 14 thereat. In this regard, the retaining member 19 of this embodiment generally should be approximately parallel with the base 16 and extend outward toward each side of the wall 18. It should be of sufficient length to permit its access into and through the channels 24. The distance between the retaining member 19 and the wall 18 is sufficient to permit movement within the channels 24 when inserted therein but should also be such as to make the fit within the channels 'snug'.

Figure 5:
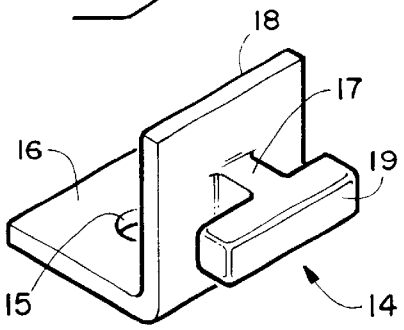
FIG. 5 is a detailed view one embodiment of the bracket member.

As so constructed, by rotating the retaining member 19 about 90° along the axis of the shaft 17 the retaining member 19 then could be fitted through the channel 24 up to the shaft 17 to thereby permit the opposite end of the retaining member 19 to be placed through the channel 24 such that the wall 18 rests against the body 20. The retaining member 19 would then be rotated back to its original position. FIG. 5 is a view of the bracket member 14 outside of the channel 24 depicting its proper up and down position in the screed; but it can be placed in a screed up-side-down depicted in FIG. 4. This shows that, once the bracket member 14 is so inserted into the channel 24, it would resemble that figure except that the shaft 17, of course, would reside inside the channel 24 and could still translate up and down therein to permit horizontal adjustment as necessary.

The bracket member 14 also has an aperture 15 in the base 16 to accommodate a fastener therethrough. The aperture 15 may be or any size and any configuration (See FIG. 12 for an elongated oval-like aperture 315 which accommodates slight lateral movement of the bracket member as the screeds are being horizontally adjusted). Any suitable fastener 23 will suffice, such as, but not limited to, nails, screws, staples, tacks, and the like. Using a nail is most common. Once the bracket member 14 is placed into the channels 24, the base 16 is placed on top of the existing surface 26 and a nail would be driven into the existing surface 26 through the aperture 15. This attaches the screed assembly 10 to the existing surface 26 and also provides vertical stability to the screed assembly 10 while an artisan then makes horizontal adjustments and alignments. Once a true horizontal is established, the screed assembly 10 is secured to the external object by way of one or more sets of one or more vertically disposed apertures 25 near the bottom rail 30B of the body 20 through which generally one suitable fastener (such as a nail) per set may be driven. Since it is best to drive the nail into the meatiest section 29 of the external object, and since through horizontal adjustments, were there only one such aperture, it could be below the meatiest part, more than one such aperture are provided per set. In the embodiments illustrated, I have found that three apertures per set, spaced vertically apart between about one-eighth of an inch to about three-eighths of an inch apart will accommodate this requirement. Best spacing is about three-sixteenth of an inch apart.

Figure 4:
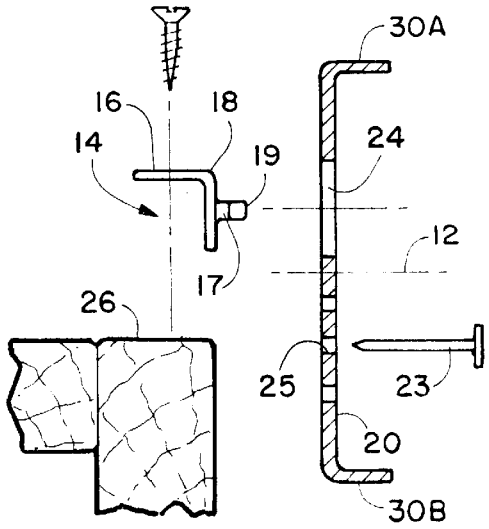
FIG. 4 is a detailed elevation side view of the screed assembly application onto an existing surface.
Figure 6:
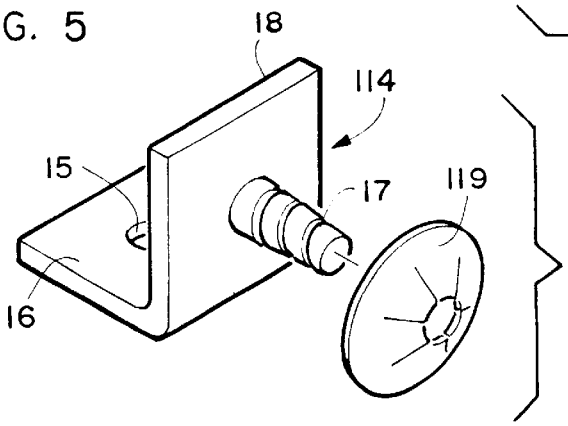
FIG. 6 is a detailed view of another embodiment of the bracket member.

It must be understood that the channels 24 may be near the top rail 30A (as illustrated) or may be near the bottom rail 30B and that the bracket member 14 may insert into the channels 24 with the base 16 up (proximal to the top rail 30A, as illustrated in FIG. 4) or with the base 16 down (proximal to the bottom rail 30B) as illustrated in FIGS. 5 and 6. How they insert will relate to the location of the channels 24 and the desired depth of the sub-base 27.

Large holes 22 may, but need not be on the body of the present invention particularly when the top rail 30A and the bottom rail 30B are angled downward or upward, respectively. Large holes, however, are required in the prior art screeds 10' to permit the mortar, which is placed on the existing top surface, to flow through and onto the side between the top rail 30A and bottom rail 30B to create a new side surface for tiles and to provide a means by which the mortar on the sides can be held on the sides without falling off. With angled rails, the angling supports and holds the mortar onto the sides.

Figure 3:
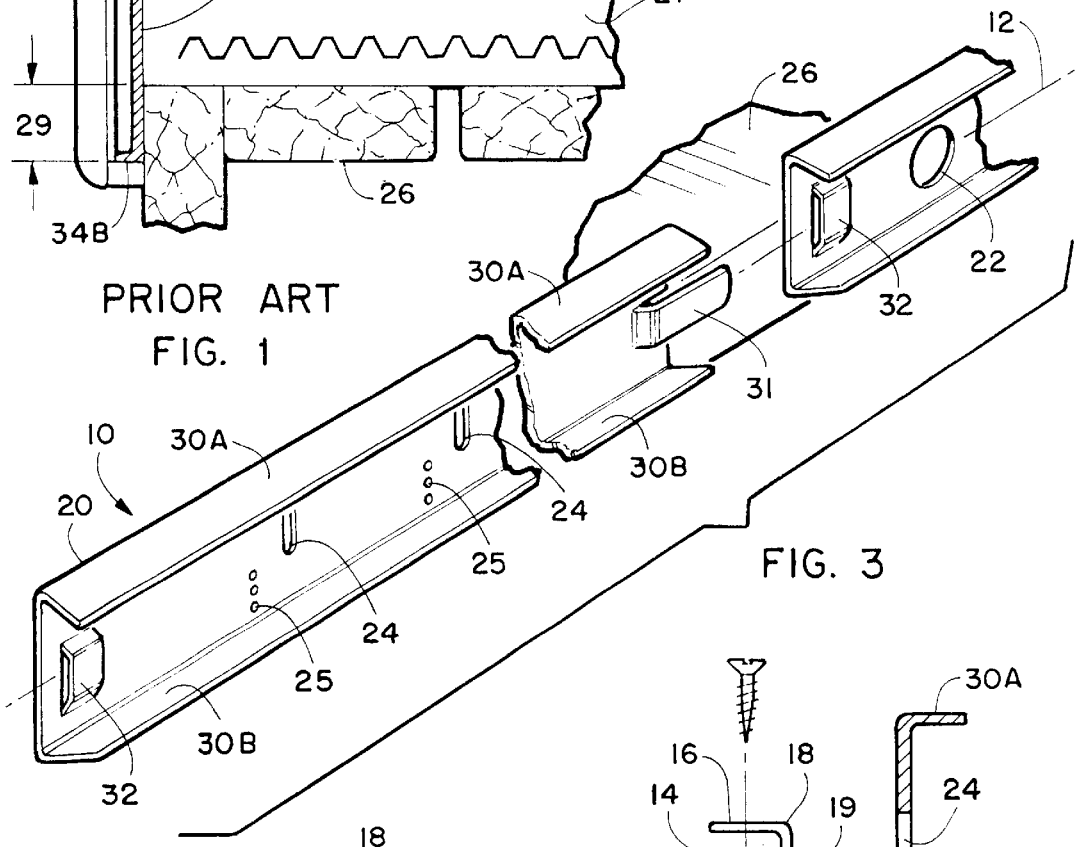
FIG. 3 is a perspective view of one embodiment of the improved screed assembly.

An outstanding and unique feature of the present invention aside from the vertical stabilization and horizontal adjustability and securability, is the registration capability between multiple screeds after only one screed has been secured to the external object. FIG. 3 illustrates one such registration configuration. In this figure, one end of the screed assembly 10 has an extension 31 whereas the other end has a receptacle for a similar extension 31 on another screed assembly. It must be understood that on what end which registration member is on is immaterial provided that each screed assembly 10 has one of each on opposite ends.

Therefore, when one screed assembly 10 is secured to an external object on one side of the external object (after it has been horizontally adjusted), other screed assemblies 10 are merely fitted into corresponding extensions 31 or receptacles 32 for that side. It must also be understood, using the registration members described herein will require generally only one screed assembly 10 per side of the external object. Other screeds for the same side may be similar screed assemblies 10 but need not be. Other screeds would not require the bracket member 14, or the channels 24, as they would register with the originally secured screed assembly 10 and, as such, share the same horizontal alignment as the originally secured screed assembly 10. After at least one complete screed assembly 10 has been secured to each side of the external and a unitary horizontal plane established for each of them, other screeds may simply be attached by registration with the originally secured screed assembly 10 on the respective side.

FIG. 14 is a more detailed view of this registration mechanism. The extension 31 lies on, or may be cut from, the inside surface of the body 20 and extends outward. The receptacle on the other end of the body 20 is configured to tightly receive the extension 31 from another screed. As constructed and fitted, the body 20 of each screed share the same plane; that is, they form a relatively straight line against the external object. The outside surface of the top rail 30A of each screed also share the same plane thereby creating a unitary horizontal plane formed by the perimeter of all registered screeds. Generally, the extension 31 and receptacle should be, but need not be, at the centers 12 of each end of the screed. They could be above or below center 12 also and still function as described above.

Figure 7:
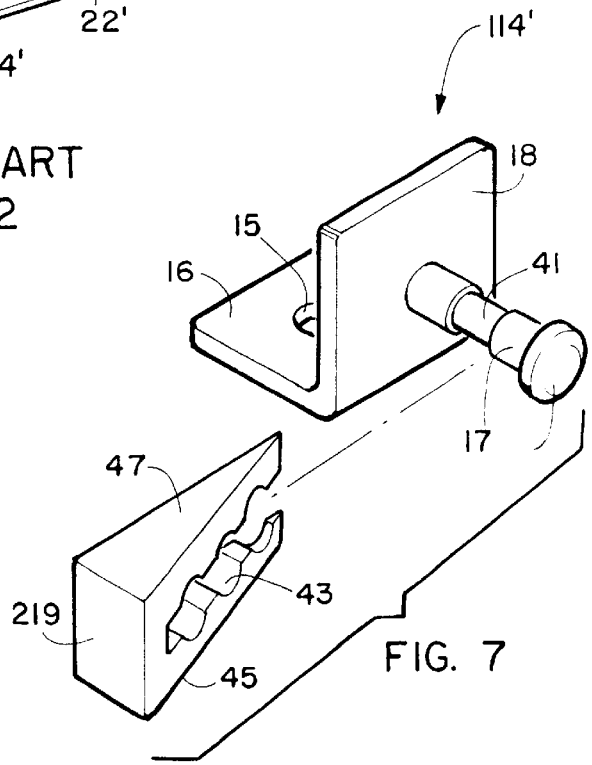
FIG. 7 is detailed view of another embodiment of the bracket member.

Another embodiment of the bracket member 114 briefly mentioned earlier is illustrated in FIG. 6. This bracket member 114 shares the same features of the previously described bracket member 14 except that the retaining member 119 is removable from the shaft 17. This bracket member 114 inserts more easily into the channel 24 and, once inserted, the retaining member 119 is pressed or screwed or otherwise secured onto the shaft 17 to more firmly maintain the bracket member 114 in the channel 24 while still permitting vertical translation therein. Any suitable retaining member 119 suited for the intended purpose will suffice including, but not limited to, grommets, rubber washers or bushings, push-pins, locking or webbed washers, cotter-pins, and nuts. The shaft 17 may be rounded, oval, triangular, squared, tapered, threaded, smoothed, roughened, have a hole transversing the shaft, a slit (as illustrated in FIG. 7, reference character 41 and described later), and the like, or any combination thereof. The retaining member 119 must snugly or tightly retain the bracket member 114 within the channel 24 yet permit vertical movement of the shaft 17 through the channel 24 or, conversely, vertical movement of the attached screed through the shaft to thereby permit horizontal alignment of the screed assembly 10.

Figure 8:
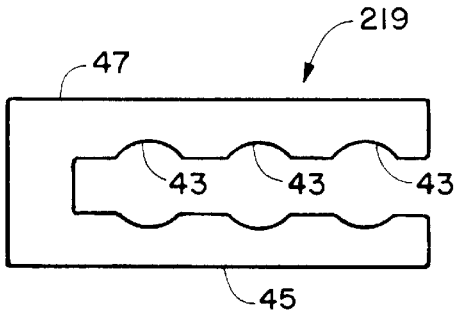
FIG. 8 is a detailed view of the retaining mechanism for the bracket member illustrated in FIG. 7.

FIGS. 7 and 8 illustrate yet another embodiment bracket member 114'. This bracket member 114' is very similar to that which was described above and illustrated in FIG. 6 except that the shaft 17 has a slot 41 around the shaft 17 and a blunt or mushroom-like end 45. This bracket member 114' inserts through the channel 24 but then a wedge-like retaining member (or clip) 219 is pressed into and seated over the shaft 17. As the wedge-like retaining member 219 is pushed over the shaft 17, because it is wedge-like, the farther it is pushed over the shaft 17, the more is presses against the mushroom-like end 45 and against the wall screed body 20 and the wall 18 of the bracket member 1141. The more it is pushed in, the greater its hold. FIG. 8 is a detailed illustration of the wedge-like retaining member 219. It has a cut-out between the top 47 and the bottom 45. There are one or more grooves 43 on the upper and lower surfaces of the cut-out. In operation, the cut-out of the wedge-like retaining member 219 is placed over the shaft 17 and is pushed over the shaft 17 until one of the grooves 43 securingly mates with the slot 41 on the shaft 17 and one side of the wedge-like retaining member is also firmly pressed against the mushroom-like end 45 and the other side of the wedge-like retaining member is firmly pressed against the screed body 20 (and indirectly, against the wall 18 of this bracket member 114'.

Another embodiment of the screed assembly 210 is illustrated in FIGS. 9 through 12. This assembly also has a body 220 with a top rail 30A, a bottom rail 30B, one or more sets of one or more apertures 25 in the body 220 for securing this screed assembly 210 to an external object, and the registration mechanism 31, 32, as was discussed above. The main difference here lies in the horizontal adjustment mechanism's bracket members 214 and 314 and the projecting strips 224 on the body 220. These projecting strips 224 are two parallel cuts, generally situated above the center-line 12 of the body 220, which are parallel to the rails and are pushed out rearward of the body 220 leaving a space 225 in the projecting strip 224 to accommodate the projection 217 of the second embodiment bracket member 214 (see FIG. 11). This inner surface of the space 225 which accepts the projection 217 also may be a roughened surface, may be corrugated, may be dimpled, or may be wavy, and the like, or any combination thereof, to better hold the projection 217.

This bracket member 214 is much like the previously described first embodiment bracket member 14 with base 16, wall 18 approximately perpendicular to the base 16, and aperture 15 in the base 16. The main difference is that this bracket member 214 has no shaft 17 or retaining member 19, 119. Instead it has a projection or tab 217 extending above the wall 18, and not as wide as the wall 18, which inserts tightly into the space 225 so that the screed assembly 210, when attached to an external surface by this bracket member 214, will maintain its horizontal position. Though the fit of the projection 217 into the space 225 is relatively tight (with little tolerance) to maintain the horizontal position, it is not so tight that this bracket member 214, upon application of some degree of force, cannot translate vertically within the space 225, to ride on the projection 217 up until the top (or shoulder) 218 of the wall 18 strikes the bottom of the projecting strip 224 and prevents further movement in that direction or to bring it down depending on what is required for obtaining a horizontal plane.

FIG. 12 illustrates another type bracket member 314. This bracket member is similar to the previously described bracket member 214 except that it does not have a projection (217). Instead, the wall 18 of this bracket member 314 is taller extending upward to a height about equal in height as the wall 18 plus projection 217 of bracket member 214. Note the aperture 315 in the base 16 is elongated. The aperture 315 may be elongated in a side-to-side relation to the base 16 or in a front-to-rear relation to the base 16. The side-to-side elongation of the aperture 315 fosters lateral translation when the assembly is being horizontally adjusted—which may be significant and required depending on the degree of adjustment necessary.

With either screed assembly 10, 210 the positioning of the horizontal adjustment mechanisms on the body 20, 220 is important in that such positioning is what will accord the artisan the ability to create a mortar bed 27, or equivalent, of sufficient depth necessary to establish the new top surface necessary to accommodate the new covering to be placed over it. As was stated earlier, this depth could range from about one-quarter (0.250) inch to about one and one-half inches (with three-quarter (0.750) inch being better). Screeds vary in width of the body 20 (i.e., from top rail 30A to bottom rail 30B) and vary in length (length can and generally is cut to suit the project). To better explain positioning, a screed having a body width of one and three-quarter (1.750) inches will be used as example only, not by way of limitation, so that ratios can be established. Using this example screed, the centerline 12 would be one-half the width, or seven-eighths (0.875) of an inch. To permit a suitable translation of this screed for the first embodiment, the channel should begin above the centerline 12 by about 0.0625 inches and be about 0.625 inches long. With these dimensions as ratios the length or height of the wall 18, from bottom of base 16 and up, or down (as the case may be, the wall 18, should be about 0.690 inches and the axis of the shaft 17 should be about 0.500 inches from the bottom of the base 16. This will provide a good position for the bracket member 14 to rest on the external object in relation to the screed assembly 10, 210 it will support and will also provide a sufficient ride or vertical translation to set a proper depth (up t o a maximum of 0.750 inches in this example) for the mortar bed 27 to be applied within the perimeter established.

With regard to dimensions for the second embodiment screed assembly 210 (see FIG. 9), I will use the same example screed body 20 width as a point of relative reference. In this regard the top cut of the projecting strip is about 0.500 inches from the top rail 30A and the bottom cut about 0.250 inches below the top cut. The bottom cut in this example is above the centerline 12. The full height of the bracket member 214 for this screed assembly 210 is about 0.750 inches, the height from the bottom of the base 16 to the shoulder 218 is about 0.500 inches and the height of the projection 217 on the wall at about 0.250 inches. As with the first embodiment, this permits a good vertical translation so that an accurate horizontal plane can be obtained. In this example, the bracket member 214 is used with the base 16 distal from the top rail 30A.

It must be understood that as the body 20, 220 width increases or decreases in dimension, proportional increases in positions and dimensions are or may be respectively increased or decreased accordingly. In some cases, although the body 20, 220 width increases or decreases, the depth of the mortar bed 27 remains constant with the example screed described above; i.e., about 0.750 inches.

The location of the vertically disposed apertures 25 on either embodiment will be the same. Generally the location on the body 20, 220 should be below the centerline 12 but that may not always be the case as the user may desire a long side border which would require a screed having a long body width. The meatiest section 29 of the external object might then be above the centerline 12, Though the location could be below the centerline 12 and/or at or near the bottom rail 30B, the best location is within the vicinity of the meatiest section 29. With the example screed as defined above, and with typical counter-top installations, the best location is below the centerline 12 with the center of the bottom aperture being about 0.3125 inches above the bottom rail 30B, the next aperture center about 0.1875 above the bottom aperture center, and the top aperture about 0.1875 above the center of the center aperture.

Another embodiment of the screed assembly 310 is illustrated in FIG. 18. It has the same features of the previously described embodiments as to horizontal adjustment mechanisms using any of the bracket member concepts 14, 114, 114', 214, or 314 previously described or any one or more combinations thereof. All the descriptions set forth above as to all the elements and the relative dimensions apply equally to this embodiment and are so incorporated. The major difference here is that this screed assembly 310 is a corner piece. Though shown here as an outside corner piece, the description which relates to 'corner' pieces applies to both outside and inside corner pieces. As a result, this screed assembly 310 generally is secured only to the outside or inside corners of the external object and horizontal adjustments are made at those corners. A unitary horizontal plane can be established using only the corners and, once established, the corner screeds are secured to the external object. Other screeds are connected to (registered off these) corner 5creed assemblies 310.

Figure 15:
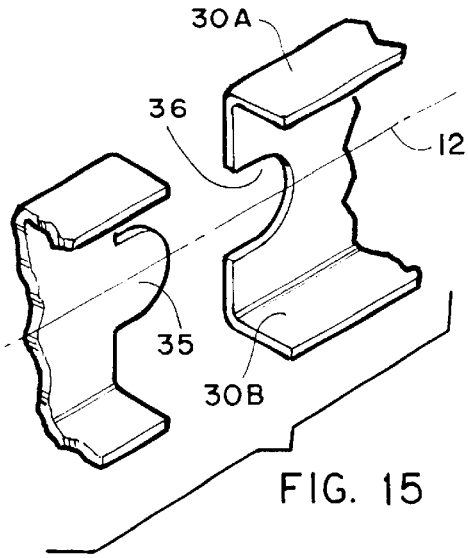
FIG. 15 is a perspective detailed view of one embodiment of the registration mechanism between multiple screeds.

Only one embodiment for registration mechanism (a two-part mechanism) was described and referred to in FIGS. 3, 9, 10, and 14. If a screed having this registration mechanism is cut, one part of its two-part registration mechanism is removed. FIGS. 13A, 13B, and 15 through 18 illustrate several other registration mechanism embodiments; the last three of which eliminate this cut-and-remove problem. FIG. 15 illustrates a tongue 35 and groove 36 concept where a screed has a tongue 35 on one end and a groove 36 on another end either of which are matable with respective grooves 36 and tongues 35 of other screeds. If screeds must be cut to fit, these two previously mentioned registration mechanisms generally will not function since one part of a two-part registration mechanism would have been cut off.

Figure 13A:
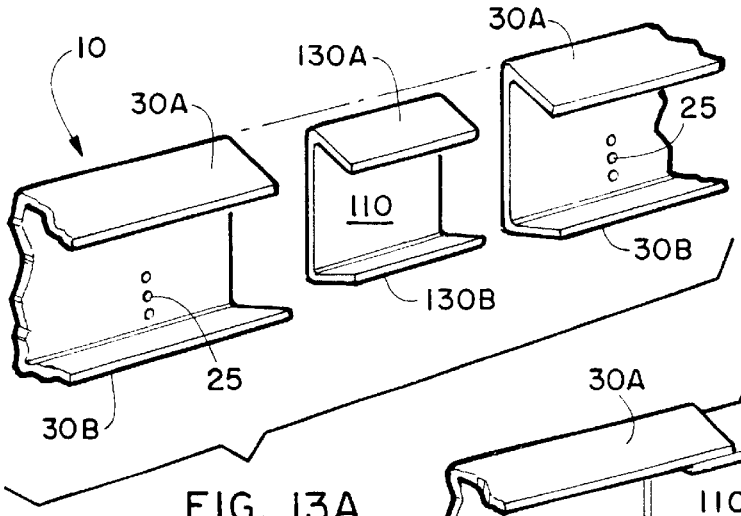
FIGS. 13A, 13B is a detailed view of an insert used as a registration vehicle.
Figure 13B:
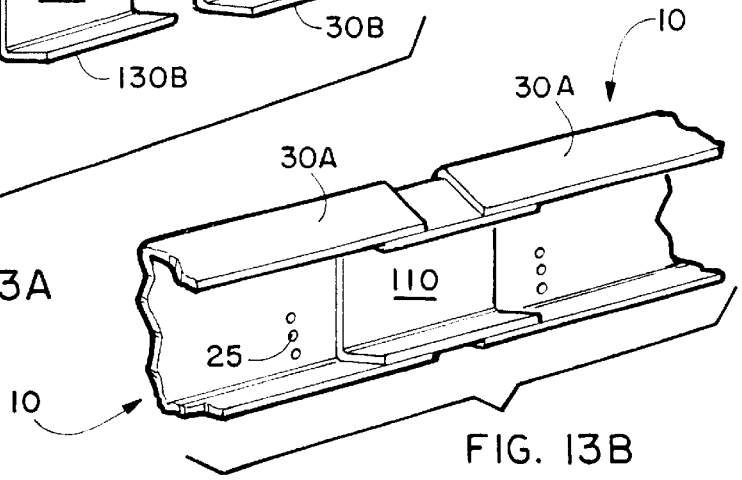

FIGS. 13A, 13B, 15, 16, and 18 illustrate three registration mechanisms where this problem associated with cut screeds is obviated. The first of these is best illustrated in FIGS. 13A and 13B. An insert or sleeve 110 is the registration vehicle between two screeds 10 on opposing sides of the insert 110. FIG. 13A represents a pre-attachment, pre-registration mode. The insert 110 is fashioned similarly as are the screeds 10 it will register. The insert 110 has a body with top rail 130A a bottom rail 130B each of which are slightly angled downward and upward, respectively. The insert body can be slightly shorter than the screed body (as illustrated in FIG. 13B) or it can be slightly taller than the screed body. In those cases where the insert body is shorter than the screed body, the insert 110 can be snapped into two screeds as shown in this figure and will be firmly held thereat.

In those cases where the insert body is taller than the screed body, the insert 110 can be snapped over the screeds or the screeds can be snapped into the insert 110. This is particularly useful and efficient where corner screeds are used as the horizontal aligning mechanism. Once the corners are all aligned, screeds 10 with inserts 110 are snapped together, cut as necessary and snapped into the corner screeds.

Figure 16:
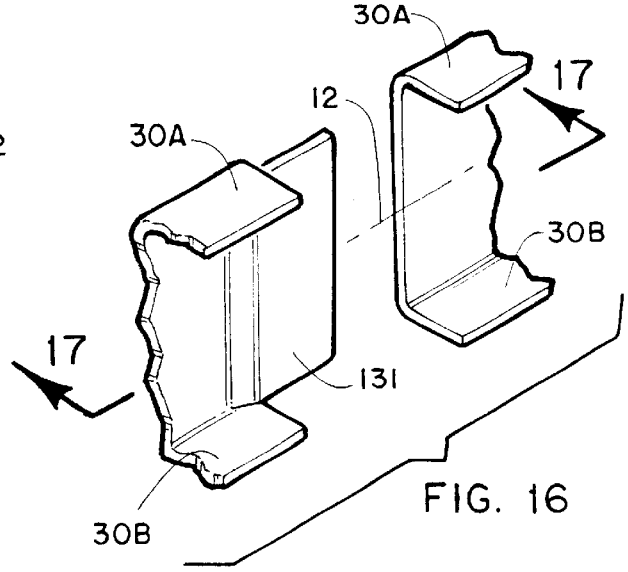
FIG. 16 is a perspective detailed view of another embodiment of the registration mechanism between multiple screeds.
Figure 17:
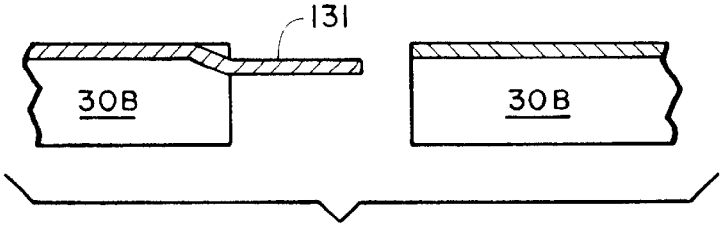
FIG. 17 is a detailed, cross-section view of the registration mechanism illustrated in FIG. 16 as taken on line 17—17 of FIG. 16.

FIGS. 15, 16, and 18 illustrate an extension 131 on only one end of a screed. This extension 131 is a full-height extension 131 whose height begins at the upper surface of the bottom rail 30B and extends upwards to the bottom surface of the top rail 30A. This extension 131 extends beyond the end of the screed to thereby be capable of snugly mating with another similar screed on the end of that screed which does not have this extension 131 between the top rail 30A and the bottom rail 30B, or with any other screeds having an open end between the top rail 30A and the bottom rail 30B (such as conventional prior art screeds). Screeds with this registration mechanism are better suited for use where screeds must be cut to fit because they always will have an open end to accept the extension 131.

The next registration mechanism is illustrated in FIG. 18. Though a corner screed is illustrated in this figure, it must be understood that this registration mechanism may be on any screed previously described and is, as is that which was shown in FIGS. 15 and 16, very well suited for use as corner screeds when other screeds must be cut to fit. This registration mechanism incorporates a pair of platforms on one or both ends of the screed; preferably on both because, if only on one end, the attaching screeds must have corresponding or similar platforms; but if on both ends, the attaching screed needn't have any platforms or corresponding registration mechanisms, but merely a plain end (or open end) with only top and bottom rails 30A, 30B thereat. These platforms may be either on the top rail 30A (platform 33A) or on the bottom rail 30B (platform 33B) or on both and generally extend below the respective rails 30A, 30B and outward from the ends of the screed. The configuration of these platforms (33A, 33B) is such that the top surface of each platform is on the same horizontal plane as the bottom surface of the rail to which attached. Therefore, when a screed having this registration mechanism is secured to an external object, and the bottom surface of the rail of another screed is placed on the platform of the secured screed, the top surfaces of the top rails 30A of each screed (the secured screed and the newly placed screed thereon) are on the same horizontal plane.

This registration mechanism may also include a top platform 33A (as previous described) and a bottom platform 33C in which the bottom surface of this bottom platform 33C should generally be on the same plane as the top surface of the bottom rail 30B and, if this bottom platform 33C is use for a screed, that end of the screed must have a top platform 33A. As described earlier, this registration mechanism may be on one or both ends of the screed; but, for the reasons stated earlier, it is best to be on both ends.

It also must be understood that the present invention of screed assemblies described herein may be straight sections (as illustrated in FIG. 1 and others), may be corner sections (as illustrated in FIG. 18), may be curvilinear, and may be of any length or body width, or any combination thereof.

The present disclosure includes that contained in the present claims as well as that of the foregoing description. Although this invention has been described in its preferred forms with a certain degree of particularity, it is understood that the present disclosure of the preferred forms has been made only by way of example and numerous changes in the details of construction and combination and arrangement of parts may be resorted to without departing from the spirit and scope of the invention. Accordingly, the scope of the invention should be determined not by the embodiments illustrated but by the appended claims and their legal equivalents.

The invention claimed is:

1. An adjustable screed comprising;

a body having a vertical front side and a vertical back side with a top rail and a bottom rail each extending outward in the direction of said front side;

horizontal adjustment means for establishing a horizontal plane for the screed and for securely maintaining the horizontal plane, wherein said horizontal adjustment means comprises a horizontal projection on said back side extending outward in the direction of said back side, said projection having a slit on its top and its bottom, and a bracket member, said bracket member having a flat base and an upstanding wall from said base wherein said wall is adapted to securingly insert into said projection from said back side through the bottom slit and through the top slit of said projection-to thereby permit horizontal adjustment of the screed and to securely maintain said bracket member in an adjusted desired position in said projection; and vertical stabilizing means for attaching the screed to an external object;

whereby when one or more screeds are being attached to the external object, said top rails of each screed are adjusted and aligned to a single horizontal plane, securely maintained at that horizontal plane, and said vertical stabilizing means maintain the attachment to the external object and maintain vertical stability of the screed as horizontal adjustments are being made.

2. The screed as claimed in claim 1 wherein said vertical stabilizing means comprises an aperture in said base of said bracket member, wherein said bracket member is attached to the external object by a suitable fastener driven through said aperture and into the external object.

3. The screed as claimed in claim 1 further comprising securing means for securing he screed to the external object.

4. The screed as claimed in claim 3 wherein said securing means comprises one or more sets of apertures on said body, each of said one or more sets of apertures comprising one or more vertically disposed apertures.

5. The screed as claimed in claim 1 further comprising registration means for registering the screed to one or more other screeds.

6. The screed as claimed in claim 5 wherein said registration means comprises a tongue on one end of the screed and a corresponding groove on another end of the screed.

7. The screed as claimed in claim 5 wherein said registration means comprises an extension on only one end of the screed and a corresponding receptacle on another end of the screed.

8. The screed as claimed in claim 5 wherein said registration means comprises a full-height extension on only one end of the screed which is adapted to matingly insert between the top rail and the bottom rail of a corresponding other end of a screed.

9. The screed as claimed in claim 5 wherein said registration means comprises a bottom-platform on said bottom rail on one or both ends of the screed upon which the bottom rail of another screed not having said bottom platform is placable.

10. The screed as claimed in claim 5 wherein said registration means comprises a top platform on said top rail on one or both ends of the screed upon which the top rail of another screed not having said top platform is placable.

11. The screed as claimed in claim 5 wherein said registration means comprises a bottom platform on said bottom rail on one or both ends of the screed upon which said bottom rail of another screed not having said bottom platform is placable and a top platform on said top rail on one or both ends of the screed upon which the top rail of another screed not having said top platform is placable.

12. An adjustable screed comprising:

a body having a vertical front side and a vertical back side with a top rail and a bottom rail each extending outward in the direction of said front side, wherein said top rail is angled downward and said bottom rail is angled upward;

horizontal adjustment means for establishing a horizontal plane for the screed and for securely maintaining the horizontal plane, wherein said horizontal adjustment means comprises a horizontal projection on said back side extending outward in the direction of said back side, said projection having a slit on its top and its bottom, and a bracket member, said bracket member having a flat base and an upstanding wall from said base wherein said wall is adapted to securingly insert into said projection from said back side through the bottom slit and through the top slit of said projection to thereby permit horizontal adjustment of the screed and to securely maintain said bracket member in an adjusted desired position in said projection; and vertical stabilizing means for attaching the screed to an external object;

whereby when one or more screeds are being attached to the external object, said top rails of each screed are adjusted and aligned to a single horizontal plane, securely maintained at that horizontal plane, and said vertical stabilizing means maintain the attachment to the external object and maintain vertical stability of the screed as horizontal adjustments are being made.

13. The screed as claimed in claim 12 wherein said vertical stabilizing means comprises an aperture in said base of said bracket member, wherein said bracket member is attached to the external object by a suitable fastener driven through said aperture and into the external object.

14. The screed as claimed in claim 12 further comprising securing means for securing the screed to the external object.

15. The screed as claimed in claim 14 wherein said securing means comprises one or more sets of apertures on said body, each of said one or more sets of apertures comprising one or more vertically disposed apertures.

16. The screed as claimed in claim 12 further comprising registration means for registering the screed to one or more other screeds.

17. The screed as claimed in claim 16 wherein said registration means comprises a tongue on one end of the screed and a corresponding groove on another end of the screed.

18. The screed as claimed in claim 16 wherein said registration means comprises an extension on- only one end of the screed and a corresponding receptacle on another end of the screed.

19. The screed as claimed in claim 16 wherein said registration means comprises a full-height extension on only one end of the screed which is adapted to matingly insert between the top rail and the bottom rail of a corresponding other end of a screed.

20. The screed as claimed in claim 16 wherein said registration means comprises a bottom platform on said bottom rail on one or both ends of the screed upon which the bottom rail of another screed not having said bottom platform is placable.

21. The screed as claimed in claim 16 wherein said registration means comprise, a top platform on said top rail on one ore both ends of the screed upon which the top rail of another screed not having said top platform is placable.

22. The screed as claimed in claim 16 wherein said registration means comprises a bottom platform on said bottom rail on one or both, ends of the screed upon which said bottom rail of another screed not having said bottom platform is placable and a top platform on said top rail on one or both ends of the screed upon which the top rail of another screed not having said top platform is placable.

23. The screed as claimed in claim 16 wherein said registration means comprises an insert having an insert body, an insert top rail which is angled downward, and an insert bottom rail which is it angled upward wherein said insert body is slightly shorter than said body-of said screed such that said insert is adapted to securingly attach to one or more screeds.

24. The screed as claimed in claim 16 wherein said registration means comprises an insert having an insert body, an insert top rail which is angled downward, and an insert bottom rail which is angled upward wherein said insert body is slightly longer than said body of said screed such that said insert is adapted to securingly attach to one or more screeds.

* * * * *